United States Patent [19]

Costello et al.

[11] 4,426,128

[45] Jan. 17, 1984

[54] BRUSH CONTACTS

[75] Inventors: Samuel J. Costello, Nineveh; Eric R. Sohne, Hartwick, both of N.Y.

[73] Assignee: The Bendix Corporation, Southfield, Mich.

[21] Appl. No.: 319,496

[22] Filed: Nov. 9, 1981

[51] Int. Cl.[3] ..... H01R 4/18

[52] U.S. Cl. ..... 339/276 T; 339/47 R; 29/863

[58] Field of Search ..... 339/47 R, 49 R, 276 R, 339/276 T; 174/84 C; 29/863, 874, 876, 882

[56] References Cited

U.S. PATENT DOCUMENTS

| | | | |
|---|---|---|---|
| 2,280,352 | 4/1942 | Penfold et al. | 29/863 |
| 2,314,884 | 3/1943 | Klein | 174/84 C |
| 2,480,280 | 8/1949 | Bergan | 339/276 T |
| 2,622,314 | 12/1952 | Bergan | 29/148 |
| 2,803,695 | 8/1957 | Woolley, Jr. | 174/87 |
| 2,816,276 | 12/1957 | Fuller et al. | 339/276 T |
| 2,921,618 | 1/1960 | Fuller | 153/1 |
| 2,927,150 | 3/1960 | Amigh et al. | 339/276 R |
| 3,006,983 | 10/1961 | McDurmont | 174/94 |
| 3,185,762 | 5/1965 | Shaw | 174/1 |
| 3,255,430 | 6/1966 | Phillips | 339/252 |
| 3,451,116 | 6/1969 | Shields | 29/200 |
| 3,511,075 | 5/1970 | Boggio et al. | 72/402 |
| 4,120,556 | 10/1978 | Waldron et al. | 339/276 T |
| 4,206,958 | 6/1980 | Hall et al. | 339/49 R |
| 4,242,790 | 1/1981 | Ellingson et al. | 339/49 R |
| 4,253,234 | 3/1981 | Niles et al. | 29/882 |
| 4,272,150 | 6/1981 | Fairbairn | 339/276 T |
| 4,312,125 | 1/1982 | Waghorn | 29/874 |

FOREIGN PATENT DOCUMENTS

| | | | |
|---|---|---|---|
| 675592 | 12/1963 | Canada | 29/882 |
| 41032 | 12/1981 | European Pat. Off. . | |
| 1018123 | 10/1957 | Fed. Rep. of Germany | 339/276 R |
| 1221726 | 7/1966 | Fed. Rep. of Germany . | |

*Primary Examiner*—John McQuade
*Assistant Examiner*—Gary F. Paumen
*Attorney, Agent, or Firm*—John R. Benefiel; Raymond J. Eifler

[57] ABSTRACT

A method of crimping contact wires (24) into a holder (26) of a brush contact (24) in which a converging series of indentors (16) each having a Vee-shaped tip (72) are advanced into the holder by a cam sleeve (30) engaging cam surfaces (18) on each indentor, to form valley-shaped crimp recess (78) forcing the holder material between adjacent pairs of contact wires (24), which arrange themselves in a symmetrical pattern during the crimping. A series of flats (70) are also formed on the holder (26) end to tightly bundle the contact wires (24) projecting from the holder (26). The indentors (16) and holder (26) are mounted in a nest (14) during the crimping process.

5 Claims, 10 Drawing Figures

BRUSH CONTACTS

This invention relates to electrical connectors and more particularly to contacts used therein and techniques for crimping fine wires, such as are used in brush contacts, into a receiving holder.

One example of an electrical connector utilizing a "brush" type contact may be found in U.S. Pat. No. 3,725,844 entitled "Hermaphroditic Electrical Contact" and issued Apr. 3, 1973. Such brush contacts consist of a bundle of small diameter contact wires mounted in a holder such as to project the free ends of the wires. The ends of the contact wires are suitably angled and are adapted to be intermeshed with a similar set of contact wires in a mating brush contact to establish an electrical connection. Such brush contacts have distinct advantages in certain contexts, including great repeatability of the electrical resistance over a wide range of temperature and vibration conditions. A low insertion force is also another feature of such connectors. The projecting contact wires constituting each brush contact are vulnerable to mechanical damage and accordingly such contacts which project from the connector structure are surrounded with protective shrouds or sleeves. The shrouds or sleeves during mating engagement of the connector are received over the outside diameter of the holder of the mating contact.

A common technique for securing the contact wires into the holder is by crimping. The wires are inserted into a holder consisting of a tube of thin plated metal which tube is placed into a crimping apparatus which forces the sides of the holders inwardly such as to be deformed into tight contact with the contact wires. This approach is simple and low in cost.

The configuration of the crimping apparatus includes indentors which are disposed about the holder within the apparatus and moved inwardly to force the holder sides against the contact wires. The indentors are typically four in number.

This technique while having the aforementioned advantages also has a number of disadvantages. The random spacing and disposition of the contact wires results in an erratic deformation process which produces an inconsistent configuration of the crimped brush contact in which the concentricity of the brush contact wires and the holder is sometimes excessive and the outside diameter of the crimped holder varies considerably. This variation may produce an interference between the holder and the mating contact shroud, resulting in shaving of metal by the shroud from the holder of the mating brush contact, and increasing the insertion force.

The pattern of metal flow is also random depending on the disposition of the brush contact wires producing the variation in the crimp pattern which leads to variations in the retention force.

In addition, the resultant brush contacts are not uniform in the orientation of the contact wires. The metal flow about the contact wire does not produce a tight interfit between the holder metal and contact wires and between each wire, sometimes reducing the retention force existing between the crimped holder and the contact wires.

The contact wires are also sometimes deformed in such a way as to cause a splay, i.e., the individual contact wire may be bent to extend away from the remaining contact wires in the bundle, necessitating a scrapping of the particular brush contact. Sometimes a relatively loose bundle results which reduces the consistency in the electrical resistance characteristics of the connector utilizing such brush contact.

The indentors used in such process are of a geometry which is difficult to machine such that the apparatus was rendered relatively costly.

DISCLOSURE OF THE INVENTION

The present invention is a method and apparatus for crimping contact wires into a holder and is characterized by simultaneously forcing a plurality of indentors each having a Vee-shaped tip into the side of the holder in which the contact wires are disposed, to create valley shaped crimp recesses forced between adjacent pairs of contact wires.

This crimping process has been found to produce a symmetrical arrangement of wires wherein a central wire is surrounded by the remaining wires. The holder is crimped tightly into each opening between the wires, and each of the wires are forced tightly together, to eliminate all voids.

The indentors are also provided with a series of flats together forming a hexagon which are located above the tip such as to crimp the outer end of the holder which thus acts as a bundler for positioning each of the contact wires into a tight bundle.

The present invention has the advantage of producing a consistently concentric contact wire bundle and crimped holder and the crimped holder is of much more uniform diameter than the crimped holders according to the prior art processes.

The method according to the present invention also has the advantage of producing a tight, consistent crimping pattern in which all of the voids are eliminated to produce consistent brush retention forces. The contact wires are ordered by the crimping process and contact with the indentors, which produces the symmetrical pattern of a central contact wire surrounded by the remaining contact wires.

The method also has the advantage of greatly reducing the incidence of bending of the contact wires during the crimping process and also insuring a tight contact wire bundle. The tight bundle in turn has the advantage of reducing the contact resistance due to the improvement in the contact area between mating brush contacts.

BRIEF DESCRIPTION OF THE DRAWINGS

FIG. 1 shows the overall arrangement of the apparatus 10 used to implement the method according to the present invention. This includes a nest 12 having a generally cylindrical body portion 14.

Figure 1:
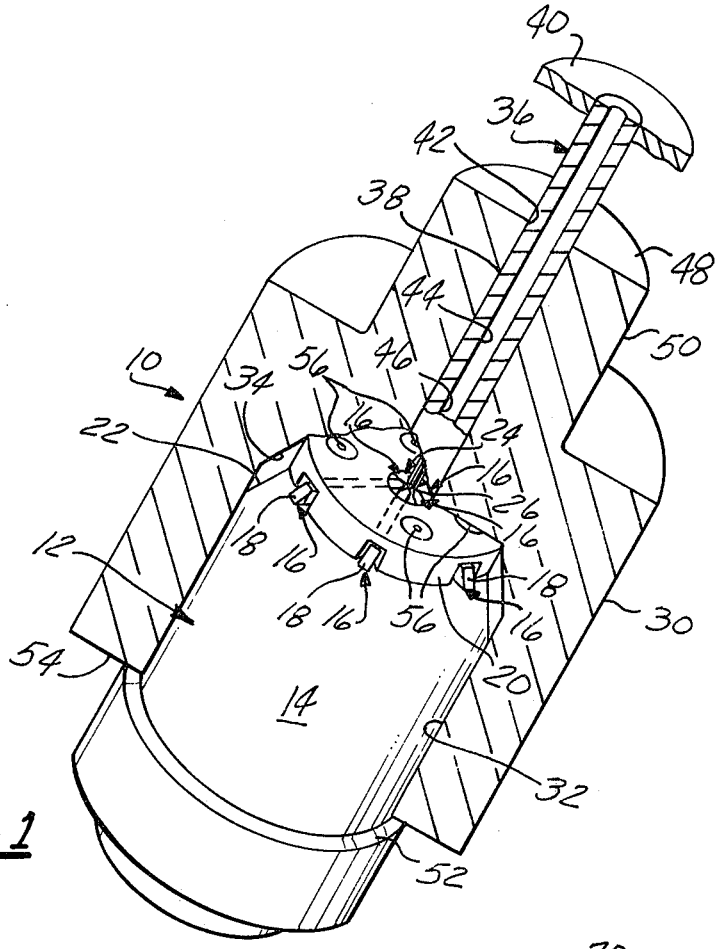
FIG. 1 is a partially sectional perspective view of a crimping apparatus according to the present invention.

Mounted atop the nest 12 is a radially convergent series of six bar-shaped indentors 16, each including a sloping cam surface 18 on the projecting ends thereof protruding from beneath a nest cover 20 and overhanging a relief surface formed by a taper section 22 machined into the body section 14 beneath the ends of the indentors 16. Each of the indentors 16 converge to a central region within which is disposed the brush contact 24 to be crimped as will be described hereinafter in further detail.

The brush contact 24 includes a holder 26 and a series of contact wires 28 each having one end received within the holder 26 and their free ends projecting upwardly from the region whereat the indentors 16 are located.

The holder is made of a formable conductive material such as a plated thin metal sleeve.

A camming sleeve 30 having an interior bore 32 is slidably received over the body section 14. The camming sleeve 30 is also formed with a complementarily-shaped internal shoulder 34 which is matched to the sloping external shoulder 32 formed on the body section 14 and adapted to come into mating engagement with the sloping cam surfaces 18 on the projecting ends of each of the indentors 16.

There is also provided a prebundler tube 36 including a tubular portion 38 and a flange 40 secured to the protruding end portion. The tubular portion is received within a corresponding bore 42 formed into one end of the cam sleeve 30. The tubular portion 36 is formed with an internal passage 44 having a chamfer 46 at the open end thereof disposed within the cam sleeve 30 and adapted to be advanced to enclose the contact wires 28 to maintain the wires in a tight bundle prior to crimping of the holder 26.

The flange 40 seats against an end face 48 of a pilot section 50 wherein the bore 42 is formed. The nest 12 is formed with an external shoulder 52 which is adapted to abut an end face 54 of the cam sleeve 30 upon full advancing of the end sleeve 30 over the nest 14. This abutment or stop limits the advance of the cam sleeve 30 over the nest 14.

In this position the indentors 16 have each been cammed radially inwardly a predetermined distance sufficient to execute the crimping process on the brush holder 26. A nest cover 20 is affixed to the nest 12 by a series of machine screws 56 and retains the indentors 16.

Figure 2:
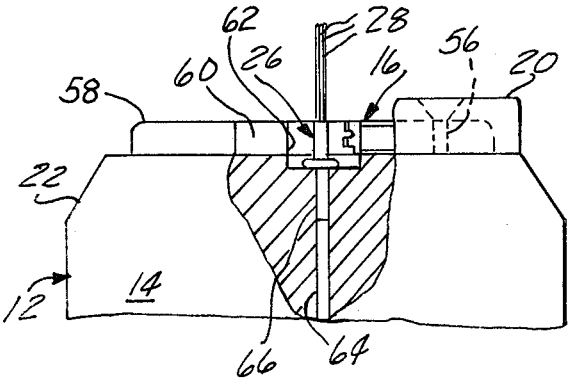
FIG. 2 is a fragmentary partially sectional view of the nest component shown in FIG. 1 with a holder and contact wire bundle installed therein.

FIG. 2 shows the upper end of the nest portion 14 which is formed at one end with a reduced diameter boss portion 58 in turn formed with a series of corresponding slots 60 which are convergent towards a central bore 62. The bore 62 receives the holder 26 with the contact wires 28 assembled thereinto, with a smaller diameter bore 64 receiving pin 66 of the holder 26 to locate the holder 26 aligned with the axis of the bore 62 and at the convergent axis of each of the inductors 16.

One of the indentors 16 is removed in FIG. 2, showing the slot 60 for clarity.

Figure 3:
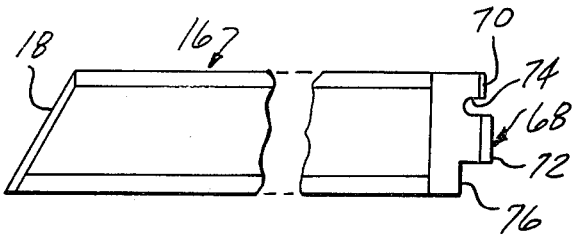
FIG. 3 is a fragmentary side view of indentors with the indentors shown in FIG. 1 forming part of the crimping apparatus according to the present invention.

FIG. 3 shows that each of the inductors 16 is comprised of an elongated bar shape having the camming surface 18 at one end and a forming tip 68 at the other.

Figure 4:
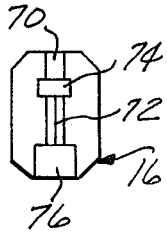
FIG. 4 is an end view of one of the indentors shown in FIGS. 1 and 3.
Figure 5:
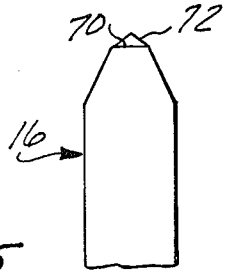
FIG. 5 is a fragmentary end view of the indentor shown in FIG. 4.

FIG. 4 also shows the details of the forming end 68 which includes a flat 70 with an angular Vee-shaped primary crimping tip 72 separated by a recess 74 formed by a relief of the forward edge to the rear of each of the crimping surfaces 70 and 72.

The tip 72 comprises an edge which extends generally parallel to the length of the holder 26 when both are installed in the nest 14. A lower relief 76 is also provided.

Figure 6:
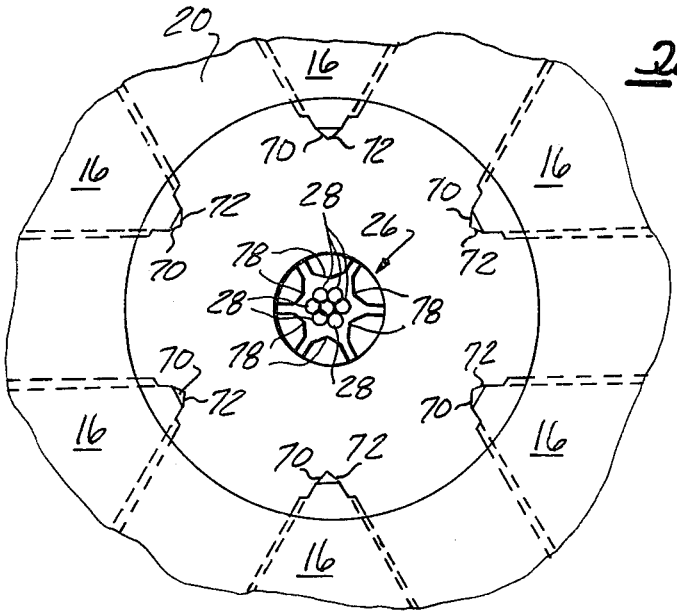
FIG. 6 is a fragmentary plan view of an array of indentors shown in FIGS. 3–5, and a crimped holder.

As shown in FIG. 6, the crimping process is primarily carried out by the Vee-shaped tip 72 in which each of the tip portions 72 is cammed simultaneously inwardly to crimp the holder 26, to create a series of crimp recesses 78. Recesses 78 are axially extending valleys having sloping sides corresponding to the Vee-shaped tip 72 of each indentor 16, the valley sides extending along the length of the holder 26 for a portion of its length. Each of the crimp recesses 78 extends between the adjacent pairs of the contact wires which are arranged about the central conduct wire, as will be described below in further detail. It has been discovered that a 120° included angle at the tip 72 produces very effectively the arrangement of the contact wires 28, and the advantageous crimping action.

Figure 7:
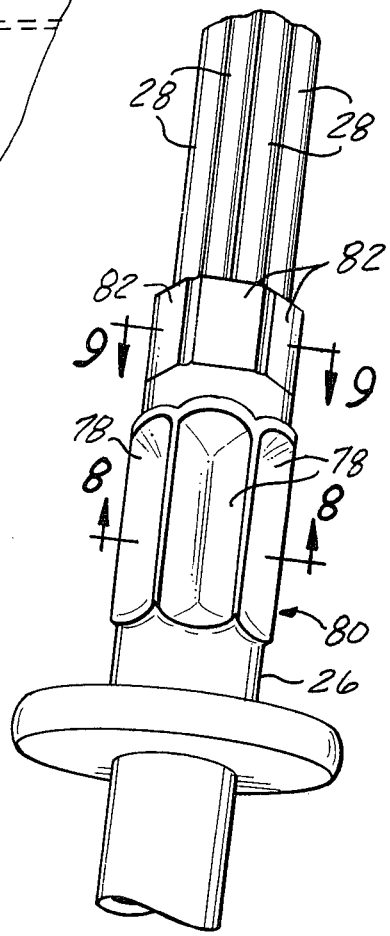
FIG. 7 is a perspective view of a brush contact holder crimped to the contact wires by the method and apparatus according to the present invention.

FIG. 7 shows the completed brush contact 80 having the axially extending parallel crimp recesses 78 substantially aligned about the circumference of the holder 26, each of the crimp recesses 78 extending along the length of the holder 26.

In addition, a series of flat sides 82 are shaped into the holder 26 during the formation of the crimp recesses 78 by the flat-forming surface 70, the flats on the one end of the holder 26 which receives the contact wires 28 and is faced from the crimp recesses 78. It has been found that forming the holder 26 with the flat sides 82 tend to force the contact wires 28 into a tighter bundle.

Figure 8:
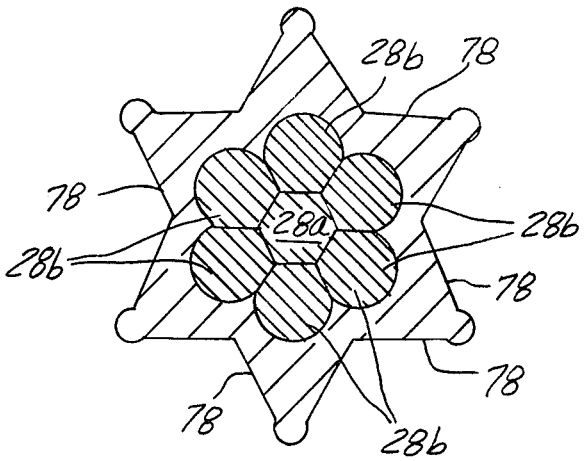
FIG. 8 is a transverse sectional view taken through the brush contact shown in FIG. 7 along Line 8—8.

FIG. 8 shows in section the resultant crimp pattern in which each of the contact wires 28 is forced into a symmetrical arrangement in intimate contact with the other contact wires 28. It has been discovered by the present inventors that the crimping method and apparatus described, causes the contact wires 28 to arrange themselves automatically in the symmetrical pattern shown in FIG. 8, with a central contact wire 28*a* with the remaining contacts wires 28*b* arranged peripherally about the central contact wire 28*a*, and each of them forced in to intimate contact with each other with very small or no voids in between.

As also can be seen, each of the crimp recesses 78 extends between adjacent pairs of the peripheral contact wires 28*a*.

The holder metal material is also forced into intimate contact with each of the contact wires 28*b* with a complete absence of voids between the holder 26 and contact wires 28*b*, such that there is reliably established an electrical connection therebetween, and also reliably generating a retention force which is enhanced by the degree of contact between the holder material and the contact wires 28*b*.

In addition, it has been discovered that the outside diameter of the crimped holder 26 is very consistent and the symmetry of the pattern affords a high degree of concentricity between the contact wire bundle and the holder outside diameter to greatly reduce the problem of interference between the shrouds and the outside diameter of the brush contact.

Figure 9:
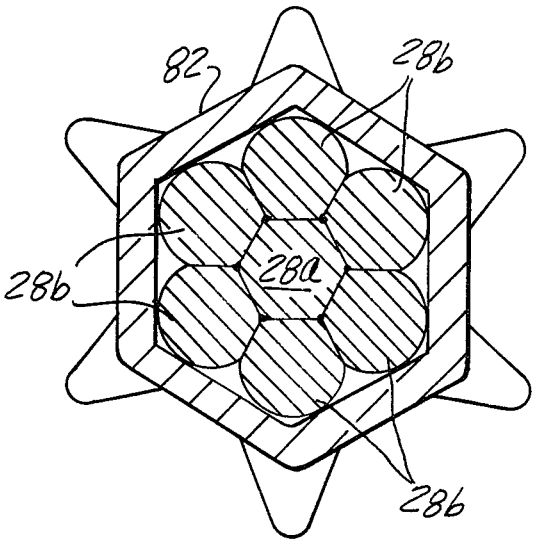
FIG. 9 is a transverse sectional view taken through the brush contact shown in FIG. 7 taken along the line 9—9.

FIG. 9 shows that a series of flats 82 are so formed which overlie to be in contact with adjacent pairs of the peripheral contact wires 28*b*. It has been discovered that crimping therein of these flats 82 at one end of the holder 26 provides for a tighter bundle by providing a support for the contact wires immediately adjacent the end of the holder 26 providing a tighter bundle and effectively less contact resistance across mated brush contacts.

Figure 10:
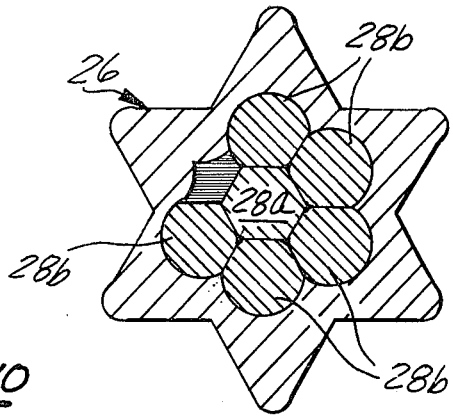
FIG. 10 is a transverse sectional view of a brush contact having one of the contact wires removed.

FIG. 10 shows that the intimate contact produced by the crimping process has been found to allow a missing peripheral contact wire 28*b* as shown in this FIGURE while still retaining a tight connection with the remaining peripheral wires 28*b*.

Accordingly, it can be seen that the method and apparatus according to the present invention produces a brush contact of superior construction having improved characteristics affording the advantages as set forth above. It should be clearly understood that other numbers of contact wires may be crimped in which the contact wires arrange themselves about the periphery of a central contact wire by the use of a corresponding plurality of indentors having angularly shaped forming tips with the corresponding number of indentors equal to the number of contact wires arranged about the periphery of the central contact wire.

Having described in the invention what is claimed is:

1. In a brush contact of the type including a plurality of parallel contact wires having one end of each received in one end of a formable metal elongated sleeve holder, said contact wires arranged with one wire located centrally of the rest of said contact wires, each of the rest of said contact wires arrayed about the periphery of said centrally located contact wire; with the holder formed with a plurality of crimps substantially aligned about the circumference of said holder and each of said recesses extending along the length of said holder and also extending inwardly to retain the contact wires therein, the improvement wherein said plurality of crimps comprise a number of generally Vee-shaped crimp recesses having sides formed into said holder arranged about the circumference of said holder, and the sides of said crimp recesses extending parallel to the length of said holder; said number of said crimp recesses being one less than the number of said contact wires; and each crimp recess extending inwardly intermediate an adjacent pair of said contact wires arrayed about said centrally located contact wire.

2. The brush contact according to claim 1 wherein said holder is further characterized by a series of flat crimps extending about the periphery of said holder adjacent said one end.

3. The brush contact according to claim 1 wherein each of said crimp recesses is formed with sloping sides having an included angle substantially equal to 120°.

4. The brush contact according to claim 3 wherein seven contact wires are crimped into said holder, with one of said seven contact wires comprising said centrally located contact wire, and the rest of said seven contact wires arranged about the periphery of said central contact wire.

5. The brush contact according to claim 4 wherein said holder is formed with flattened sides adjacent said one end, each side extending in contact across adjacent pairs of said contact wires arranged about said central contact wire.

* * * * *